US007083402B2

(12) United States Patent
Ichikawa et al.

(10) Patent No.: US 7,083,402 B2
(45) Date of Patent: Aug. 1, 2006

(54) ROTATING FLUID MACHINE

(75) Inventors: Hiroshi Ichikawa, Wako (JP); Tsutomu Takahashi, Wako (JP); Yasunari Kimura, Wako (JP); Tsuneo Endoh, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 298 days.

(21) Appl. No.: 10/739,149

(22) Filed: Dec. 19, 2003

(65) Prior Publication Data

US 2004/0234406 A1 Nov. 25, 2004

(30) Foreign Application Priority Data

Dec. 20, 2002 (JP) ..... 2002-370177

(51) Int. Cl.
*F03C 2/00* (2006.01)
*F04C 2/00* (2006.01)

(52) U.S. Cl. ..... 418/145; 418/146; 418/147; 418/116

(58) Field of Classification Search ..... 418/145–147, 418/112, 113, 116, 119–121
See application file for complete search history.

(56) References Cited

U.S. PATENT DOCUMENTS 747,418 A * 12/1903 Halewyn ..... 418/146
1,269,937 A * 6/1918 Hutsell ..... 418/147
3,585,904 A * 6/1971 White ..... 91/498
6,681,738 B1 * 1/2004 Endoh et al. ..... 418/150
6,688,865 B1 * 2/2004 Matsumoto et al. ..... 418/145

FOREIGN PATENT DOCUMENTS

JP 2000-320453 A 11/2000

* cited by examiner

*Primary Examiner*—Theresa Trieu
(74) *Attorney, Agent, or Firm*—Birch, Stewart, Kolasch & Birch, LLP

(57) ABSTRACT

A rotating fluid machine is provided with a rotor chamber, a rotor accommodated in the rotor chamber, and vanes guided by vane grooves formed in the rotor. A U-shaped vane seal is held by a seal holding groove formed in the end face of each of the vanes. The opposite ends of the vane seal are fitted into slits in seal ancillary members which are fitted into engaging holes formed in the end faces of each of the vanes. The seal ancillary members are pressed by springs toward the inner circumferential face of the rotor chamber. The pressure of a gaseous phase working medium introduced into the bottom parts of the seal holding grooves is restrained from leaking out of the ends of the vane seal by the seal ancillary members. Thus, sealing performance can be secured by pressing the vane seal against the inner circumferential face of the rotor chamber.

2 Claims, 14 Drawing Sheets

ROTATING FLUID MACHINE

This Nonprovisional application claims priority under 35 U.S.C. § 119(a) on Patent Application No(s). 2002-370177 filed in JAPAN on Dec. 20, 2002, the entire contents of which are hereby incorporated by reference.

BACKGROUND OF THE INVENTION

1. Field of the Invention

The present invention relates to a vane type rotating fluid machine which converts the pressure energy of a gaseous phase working medium into the rotational energy of a rotor and vice versa.

2. Description of the Related Art

Japanese Patent Laid-Open No. 2000-320543 discloses a rotating fluid machine provided with a vane-piston unit combining vanes and pistons, wherein pistons slidably fitted into cylinders provided in radial directions in a rotor converts the pressure energy of a gaseous phase working medium into the rotational energy of the rotor and vice versa via a power converting device composed of annular grooves and rollers, and vanes slidably supported by the rotor in radial directions converts the pressure energy of the gaseous phase working medium into the rotational energy of the rotor and vice versa.

In this rotating fluid machine, a seal holding groove is formed in the end face of each vane opposite the inner circumferential face of the rotor chamber, and a U-shaped vane seal held by this seal holding groove seals the face of the vane in sliding contact with the rotor chamber.

In the above-described conventional rotating fluid, the vane seal held by the seal holding grooves formed in each of the vanes is pressed outward in the radial directions by a centrifugal force accompanying the rotation of the rotor, and sealing performance is achieved by pressing opposite ends of the vane seal with springs against the inner circumferential face of the rotor chamber and, at the same time, causing pressure introduced from a high pressure vane chamber into the bottom of the seal holding groove to press the vane seal against the inner circumferential face of the rotor chamber.

However, as the vane seal formed in the U shape has a pair of ends, there is a fear that the pressure introduced into the bottom of the seal holding groove may leak from the ends of the vane seal, making it impossible to secure sufficient sealing merely with the centrifugal force and the urging force of the springs.

SUMMARY OF THE INVENTION

Accordingly, an object of the present invention is to prevent leakage of pressure introduced into the bottom parts of seal holding grooves, thereby securing sealing performance of the vane seal.

In order to achieve the object stated above, according to a first feature of the invention, there is proposed a rotating fluid machine provided with a rotor chamber formed in a casing, a rotor accommodated rotatably in the rotor chamber, a plurality of vanes slidably supported by a plurality of vane grooves radially formed in a rotor, and a U-shaped vane seal fitted into a seal holding groove formed in the end face of each of the vanes to be in sliding contact with the inner circumferential face of the rotor chamber, the rotating fluid machine converting the pressure energy of a gaseous phase working medium fed to a vane chamber partitioned by the rotor, the casing and the vanes, into the rotational energy of the rotor and vice versa, wherein a pair of engaging holes communicating with opposite ends of the seal holding grooves are formed in the end faces of the vanes, wherein slits opening outward in the radial direction of the rotor and closing inward in the radial direction are formed in a pair of seal ancillary members fitted into the engaging holes, and wherein the opposite ends of the vane seal are fitted into the slits.

In the configuration described above, as the pair of seal ancillary members fitted into engaging holes formed in the end faces of the vanes are provided with slits opening outward in the radial direction of the rotor and closing inward in the radial direction and the opposite ends of the vane seal are fitted into these slits. Therefore, the pressure of the gaseous phase working medium introduced into the bottom parts of the seal holding grooves can be restrained by the seal ancillary members from leaking out of the ends of the vane seal, and sealing performance can be secured by pressing with the pressure the vane seal against the inner circumferential face of the rotor chamber.

According to a second feature of the invention, in addition to the first feature, the opposite ends of the vane seal are tightly stuck into the slits in the seal ancillary members by pressing the seal ancillary members with springy members accommodated in the bottom parts of the engaging holes in the vanes.

In the configuration described above, as the springy members accommodated in the bottom parts of the engaging holes in the vanes urges the seal ancillary members, the opposite ends of the vane seal can be tightly stuck into the slits in the seal ancillary members, and the pressure of the gaseous phase working medium introduced into the bottom parts of the seal holding grooves can be prevented more reliably from leaking out of the ends of the vane seal.

Springs 77 in a preferred embodiment of the invention correspond to the springy members according to the invention.

The aforementioned and other objects, features and advantages of the present invention will become apparent from the following detailed description of the preferred embodiment thereof in conjunction with the accompanying drawings.

BRIEF DESCRIPTION OF THE DRAWINGS

FIG. 1 through FIG. 14 illustrate a preferred embodiment of the present invention, wherein FIG. 1 is a schematic diagram outlining a waste heat recovery device for an internal combustion engine;

FIG. 2 is a vertical sectional view of an expander taken on line 2—2 in FIG. 4;

FIG. 3 is an enlarged sectional view of a part around the axis in FIG. 2;

FIG. 4 is a sectional view taken on line 44 in FIG. 2;

FIG. 5 is a sectional view taken on line 5—5 in FIG. 2;

FIG. 6 is a sectional view taken on line 6—6 in FIG. 2;

FIG. 7 is a sectional view taken on line 7—7 in FIG. 5;

FIG. 8 is a sectional view taken on line 8—8 in FIG. 5;

FIG. 9 is a sectional view taken on line 9—9 in FIG. 8;

FIG. 10 is a sectional view taken on line 10—10 in FIG. 3;

FIG. 11 is an exploded perspective view of a rotor;

FIG. 12 is an exploded perspective view of a lubricating water distribution part of the rotor;

FIG. 13 is an exploded perspective view of a seal ancillary member, a spring and an end of a vane seal; and FIG. 14 is a schematic view of sectional shapes of a rotor chamber and the rotor.

DESCRIPTION OF THE PREFERRED EMBODIMENT

A preferred embodiment of the present invention will be described below with reference to the accompanying drawings.

Figure 1:
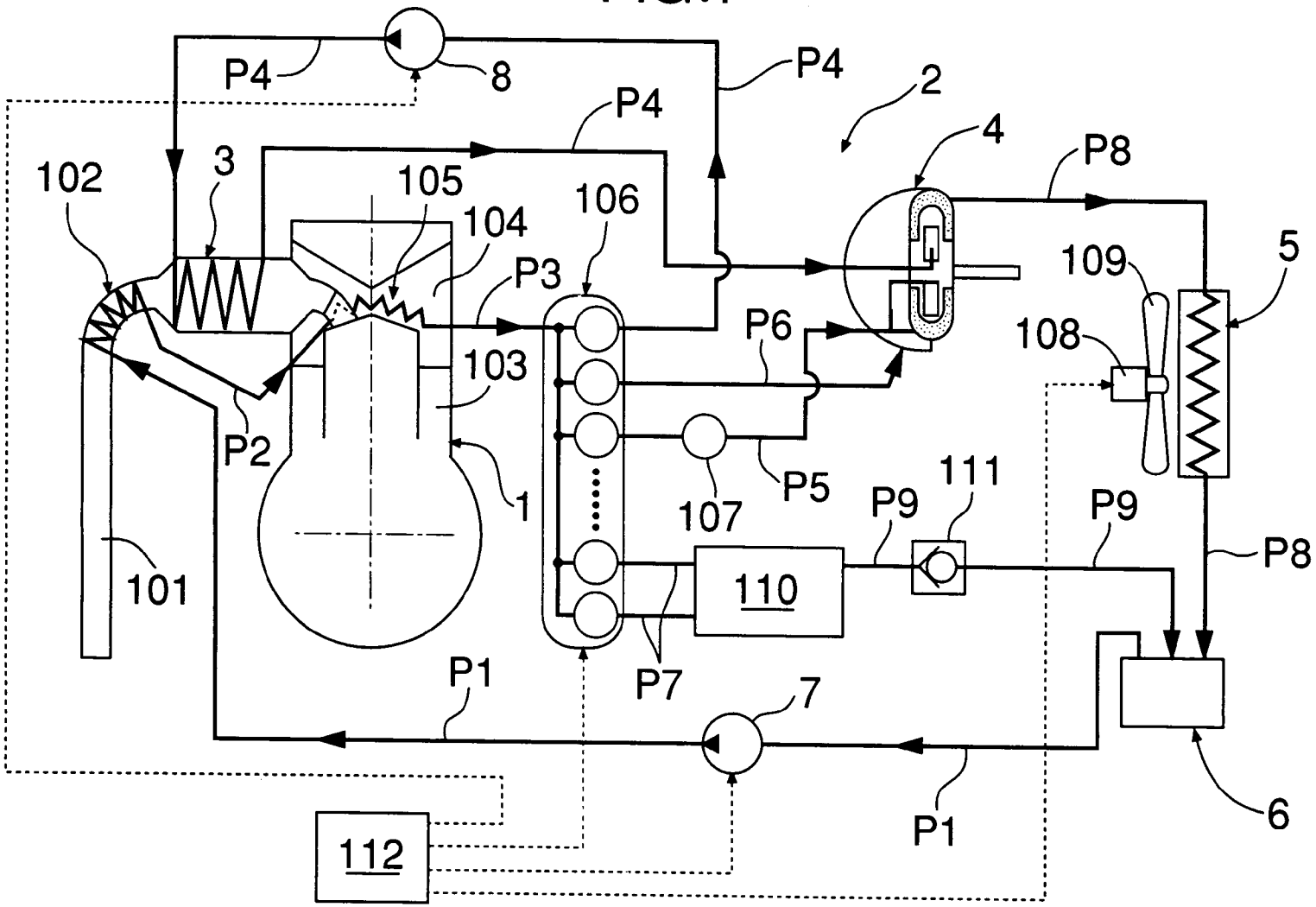

As shown in FIG. 1, a waste heat recovery device 2 for recovering the thermal energy of exhaust gas of an internal combustion engine 1 and outputting mechanical energy has an evaporator 3 for generating high temperature high pressure steam by heating water with heat derived from the exhaust gas of the internal combustion engine 1, an expander 4 for outputting axial torque with the expansion of the high temperature high pressure steam, a condenser 5 for cooling and liquefying reduced temperature reduced pressure steam discharged from that expander 4, a tank 6 for storing the water discharged from the condenser 5, and a low pressure pump 7 and a high pressure pump 8 for supplying water in the tank 6 to the evaporator 3 again.

The water in the tank 6 is pressurized to 2 to 3 MPa by the low pressure pump 7 arranged on a passage P1, and preheated as it passes through a heat exchanger 102 provided in the exhaust pipe 101 of the internal combustion engine 1. The water having passed through the heat exchanger 102 and been preheated is supplied to a water jacket 105 formed in the cylinder block 103 and the cylinder head 104 of the internal combustion engine 1 via a passage P2, cools the heat generating part of the internal combustion engine 1 as it passes therethrough, and itself is further heated as it deprives the heat generating part of its heat. The water having come out of the water jacket 105 is supplied to a distributing valve 106 via a passage P3, and is distributed therefrom to a first line communicating with a passage P4, a second line communicating with a passage P5, a third line communicating with a passage P6 and a fourth line communicating with passages P7.

The water distributed by the distributing valve 106 to the first line consisting of the passage P4 is pressurized by the high pressure pump 8 to a high pressure of 10 MPa or above, and supplied to the evaporator 3, where it exchanges heat with high temperature exhaust gas to become high temperature high pressure steam to be supplied to the high pressure part of the expander 4 (cylinders 44 of the expander 4 to be described afterwards). On the other hand, the water distributed by the distributing valve 106 to the second line communicating with the passage P5 passes a reducing valve 107 provided on the second line to become lower temperature lower pressure than the aforementioned high temperature high pressure steam, and this steam is supplied to the low pressure part of the expander 4 (the vane chambers 75 of the expander 4 to be described afterwards). In this way, as the heated water from the distributing valve 106 is converted by the reducing valve 107 into steam and supplied to the low pressure part of the expander 4, the water can effectively utilize the thermal energy received in the water jacket 105 of the internal combustion engine 1 to increase the output of the expander 4. The water distributed to the third line communicating with the passage P6 is supplied to the lubricated parts of the expander 4. As the lubricated parts of the expander 4 are then lubricated by using the high temperature water heated by the water jacket 105, overcooling of the expander 4 can be prevented to reduce the so-called cooling loss. The reduced temperature reduced pressure steam containing the water discharged from the expander 4 is supplied to the condenser 5 provided on a passage P8, exchanges heat with a cooling air flow from a cooling fan 109 driven by an electric motor 108, and the condensate water is discharged to the tank 6. Further the water distributed to the fourth line communicating with the plurality of passages P7, is supplied to the auxiliaries 110 such as a heater for warming the vehicle compartment and thermoelectric elements to discharge the heat, and the water reduced in temperature is discharged into the tank 6 via a check valve 111 provided on a passage P9.

The low pressure pump 7, the high pressure pump 8, the distributing valve 106 and the electric motor 108 are controlled by an electronic control unit 112 in accordance with the operating state of the internal combustion engine 1, that of the expander 4, that of the auxiliaries 110 and the temperature of water in the tank 6 and the like.

Figure 2:
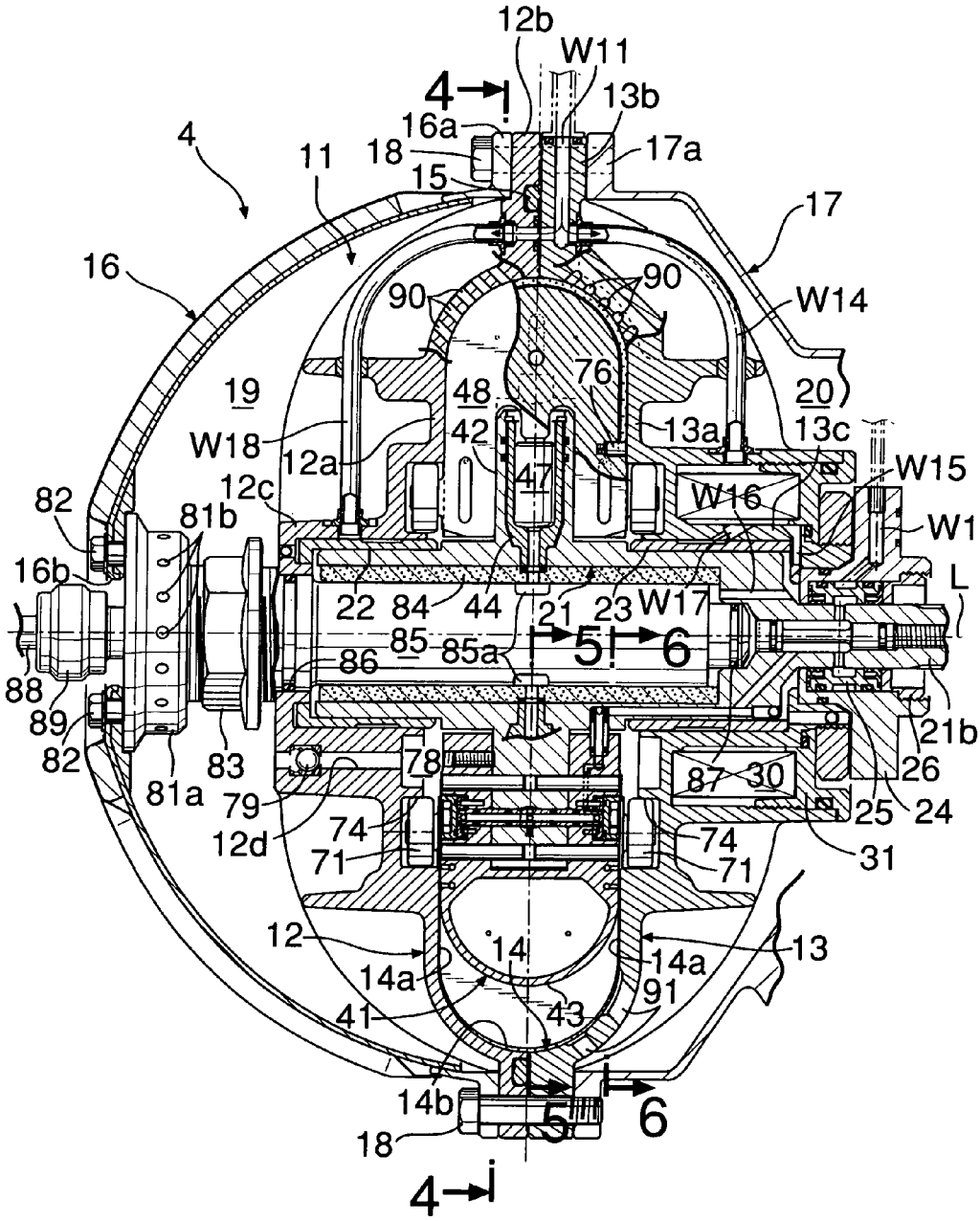
Figure 3:
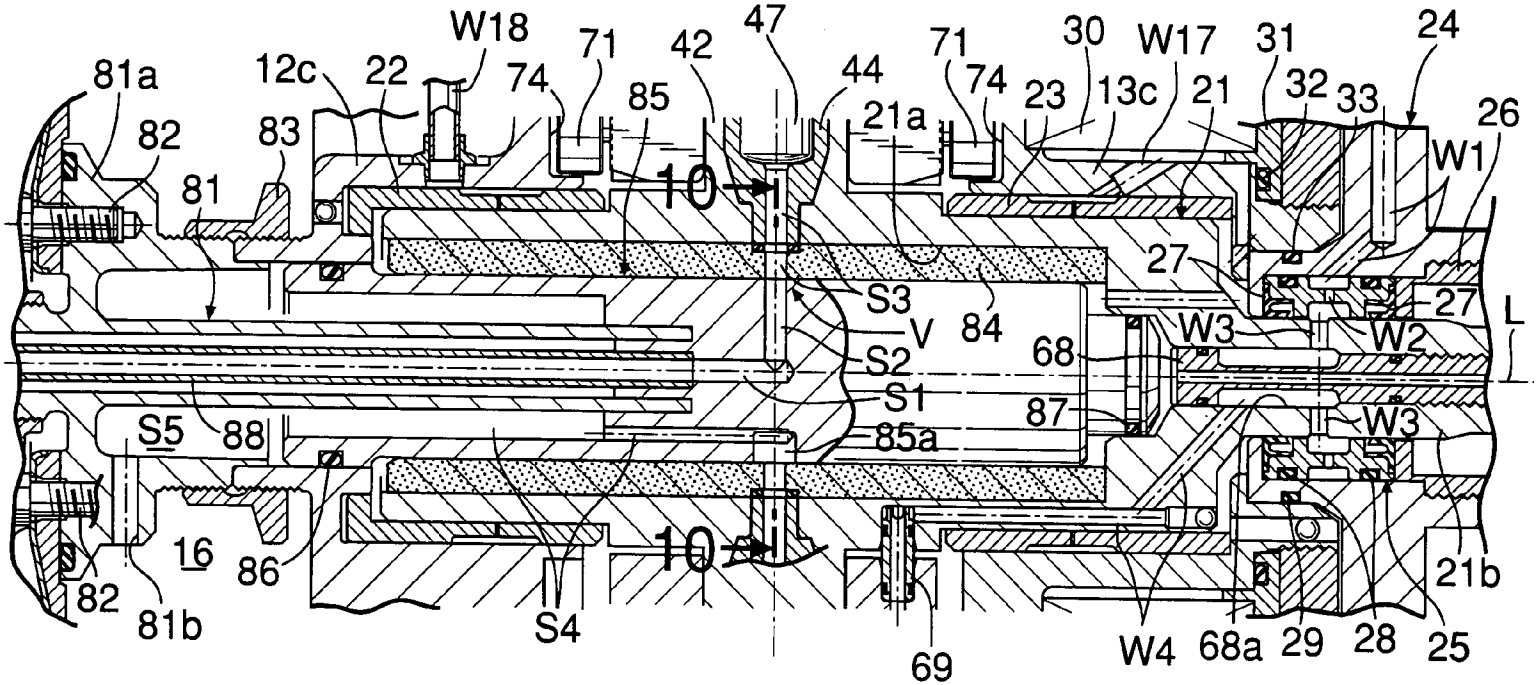

As shown in FIG. 2 and FIG. 3, the casing 11 of the expander 4 is composed of metallic first and second casing halves 12 and 13. The first and second casing halves 12 and 13 consist of bodies 12*a* and 13*a* together constituting a rotor chamber 14, and the round flanges 12*b* and 13*b* integrally communicating with the outer circumference of those bodies 12*a* and 13*a*. The two round flanges 12*b* and 13*b* are coupled to each other by a metal gasket 15. The outer face of the first casing half 12 is covered by a junction chamber outer wall 16 forming a deep bowl shape, and a round flange 16*a* communicating with the outer circumference of the outer wall 16 is laid over the left side face of the round flange 12*b* of the first casing half 12. The outer face of the second casing half 13 is covered by an exhaust chamber outer wall 17 accommodating a magnetic coupling (not shown) for transmitting the output of the expander 4 outside, and a round flange 17*a* integrally communicating with the outer circumference of the outer wall 17 is laid over the right side face of the round flange 13*b* of the second casing half 13. The four round flanges 12*b*, 13*b*, 16*a* and 17*a* are fastened together with a plurality of bolts 18 arranged in the circumferential direction. A junction chamber 19 is defined between the junction chamber outer wall 16 and the first casing half 12, and an exhaust chamber 20 is defined between the exhaust chamber outer wall 17 and the second casing half 13. The exhaust chamber outer wall 17 is provided with an exhaust port (not shown) for guiding the reduced temperature reduced pressure steam, which has finished its task in the expander 4, to the condenser 5.

The bodies 12*a* and 13*a* of the two casing halves 12 and 13 have hollow bearing cylinders 12*c* and 13*c* protruding outward to the left and right, respectively, and a rotation shaft 21 having a hollow part 21*a* is rotatably supported by the hollow bearing cylinders 12*c* and 13*c* via a pair of bearing members 22 and 23. This causes the axis L of the rotation shaft 21 to pass the intersection point of the longer axis and the shorter axis of the substantially oval rotor chamber 14.

A seal block 25 is accommodated within a lubricating water guiding member 24 screwed onto the right end of the second casing half 13, and fixed with a nut 26. A smaller diameter portion 21*b* at the right end of the rotation shaft 21 is supported within the seal block 25; a pair of seal members 27 and 27 are arranged between the seal block 25 and the smaller diameter portion 21*b*; a pair of seal members 28 and 28 are arranged between the seal block 25 and the lubricating water guiding member 24; and further a seal member 29 is arranged between the lubricating water guiding member 24 and the second casing half 13. A filter 30 is fitted into a concave formed in the outer circumference of a hollow bearing cylinder 13*c* of the second casing half 13, and prevented from coming off by a filter cap 31 screwed into the second casing half 13. A pair of seal members 32 and 33 are provided between the filter cap 31 and the second casing half 13.

Figure 4:
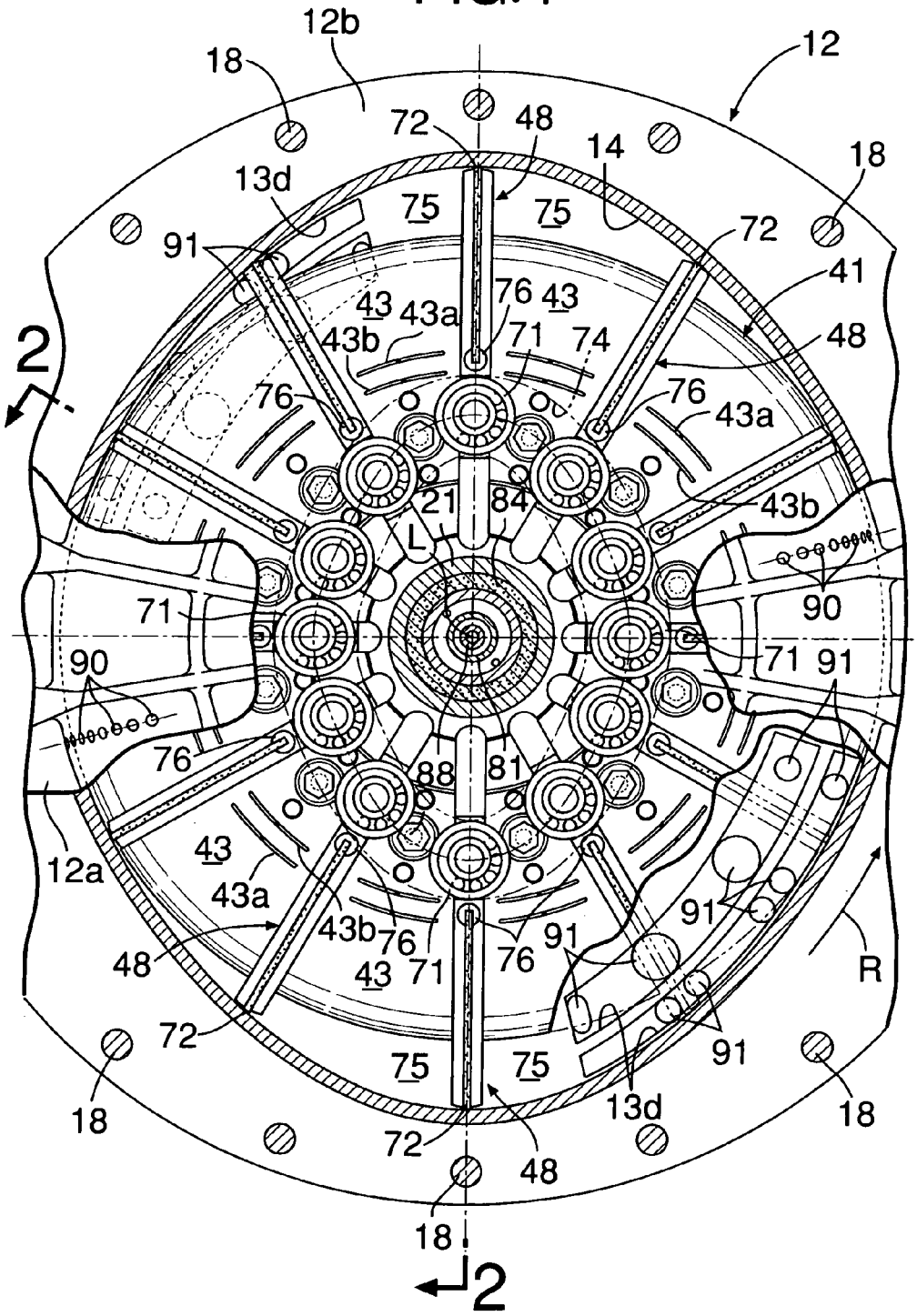
Figure 14:
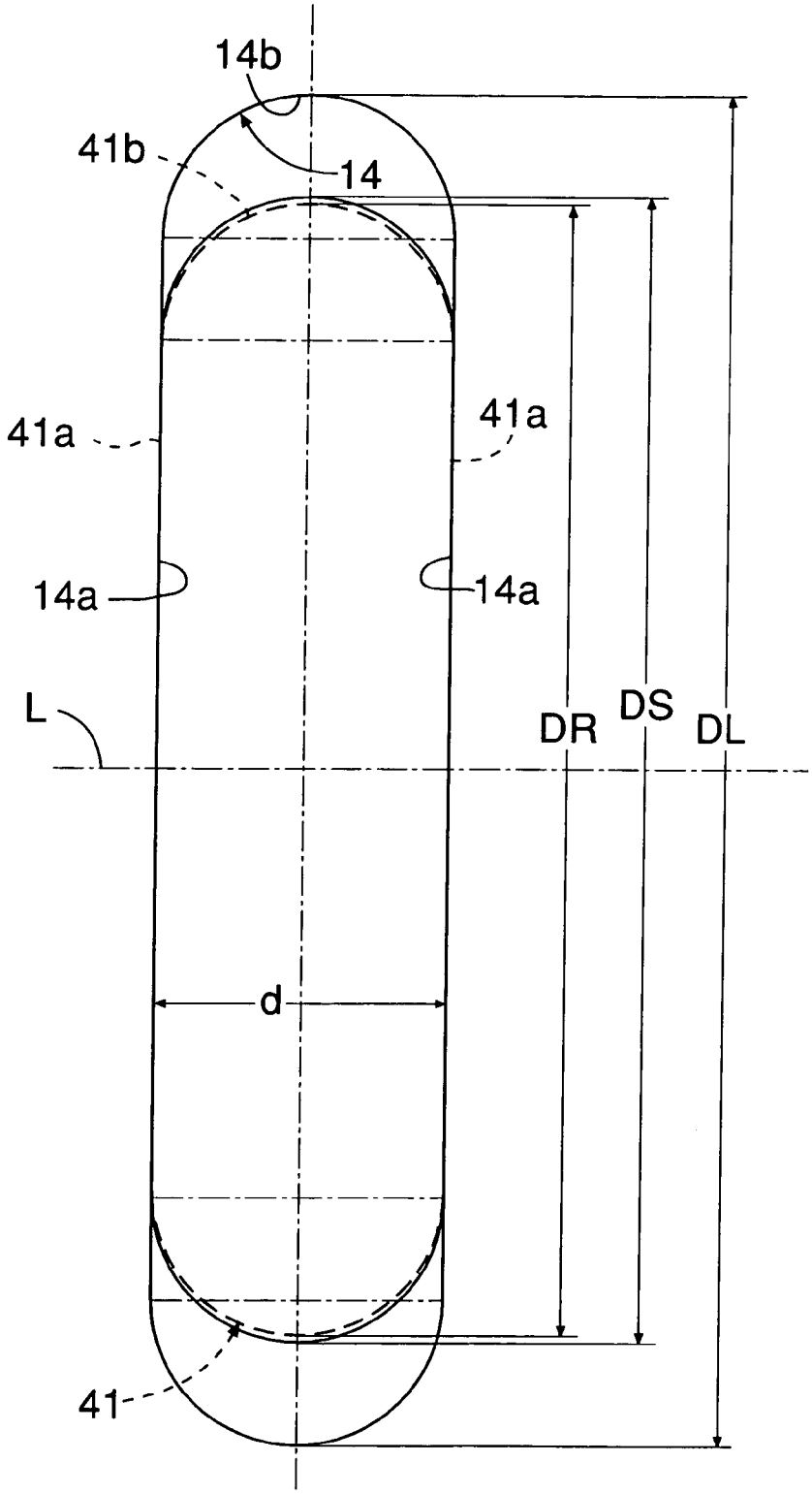

As is evident from FIG. 4 and FIG. 14, a circular rotor 41 is rotatably accommodated within the pseudo-oval rotor chamber 14. The rotor 41 is fitted onto and integrally coupled with the outer circumference of the rotation shaft 21, and the axis of the rotor 41 and the axis of the rotor chamber 14 coincide with each other with respect to the axis L of the rotation shaft 21. The shape of the rotor chamber 14, viewed in the direction of the axis L is pseudo-oval, resembling a lozenge with its four corners rounded, and has a longer axis DL and a shorter axis DS. The shape of the rotor 41 viewed in the direction of the axis L is circular, and has a diameter DR slightly shorter than the shorter axis DS of the rotor chamber 14.

The sectional shapes of both the rotor chamber 14 and the rotor 41 viewed in a direction orthogonal to the axis L are like an athletics track. That is, the sectional shape of the rotor chamber 14 consists of a pair of flat faces 14*a* and 14*a* extending in parallel with a distance d between them and arcuate faces 14*b* having a central angle of 180° smoothly connecting the outer circumference of the flat faces 14*a* and 14*a*. Similarly, the sectional shape of the rotor 41 consists of a pair of flat faces 41*a* and 41*a* extending in parallel with the distance d between them and of arcuate faces 41*b* having a central angle of 180° smoothly connecting the outer circumference of the flat faces 41*a* and 41*a*. Therefore, the flat faces 14*a* and 14*a* of the rotor chamber 14 and the flat faces 41*a* and 41*a* of the rotor 41 are in contact with each other, and a pair of crescent spaces (see FIG. 4) are formed between the inner circumferential face of the rotor chamber 14 and the outer circumference of the rotor 41.

Next will be described in detail the structure of the rotor 41 with reference to FIG. 3 through FIG. 6 and FIG. 11.

The rotor 41 consists of a rotor core 42 formed integrally with the outer circumference of the rotation shaft 21 and twelve rotor segments 43 fixed so as to cover the circumference of the rotor core 42 to constitute a shell of the rotor 41. The twelve cylinders 44 made of ceramic (or carbon) are mounted radially to the rotor core 42 at 30° intervals, and prevented from coming off with clips 45. A smaller diameter portion 44*a* protrudes at the inner end of each of the cylinders 44, and the base end of the smaller diameter portion 44*a* is sealed from a sleeve 84 by a C-shaped seal 46. The tip end of the smaller diameter portion 44*a* is fitted onto the outer circumferential face of the hollow sleeve 84, and a cylinder bore 44*b* communicates with first and second steam passages S1 and S2 within the rotation shaft 21 via third steam passages S3 penetrating the smaller diameter portion 44*a* and the rotation shaft 21. A ceramic piston 47 is slidably fitted into each of the cylinders 44. When the piston 47 has moved farthest inward in the radial direction, it is completely receded into the cylinder bore 44*b*, and when it has moved farthest outward in the radial direction, about half of its overall length protrudes out of the cylinder bore 44*b*.

Each of the rotor segments 43 is a hollow wedge-shaped member having a central angle of 30°. Two recesses 43*a* and 43*b* extending in an arcuate form around the axis L are formed on a face of each of the rotor segments 43 opposite the pair of flat faces 14*a* and 14*a* of the rotor chamber 14. Lubricating water injection ports 43*c* and 43*d* open at the centers of these recesses 43*a* and 43*b*. Four lubricating water injection ports 43*e*, 43*e* and 43*f*, 43*f* open in end faces of the rotor segments 43, i.e. the faces opposite vanes 48 to be described afterwards.

The rotor 41 is assembled in the following manner. The twelve rotor segments 43 are fitted onto the outer circumference of the rotor core 42 to which the cylinders 44, the clips 45 and the C-shaped seal 46 are mounted in advance; and the vanes 48 are fitted into twelve vane grooves 49 formed between adjoining rotor segments 43. In this process, in order form prescribed clearances between the vanes 48 and the rotor segments 43, shims of a prescribed thickness are superposed on opposite faces of the vanes 48. In this state, the rotor segments 43 and the vanes 48 are fastened inward in the radial directions toward the rotor core 42 by using a jig and, after the rotor segments 43 are precisely positioned relative to the rotor core 42, the individual rotor segments 43 are temporarily secured to the rotor core 42 with tacking bolts 50 (see FIG. 8). Then, two knock pin holes 51 and 51 penetrating the rotor core 42 are co-machined with the rotor segments 43, and four knock pins 52 were press-fitted into those knock pin holes 51 and 51 to couple the rotor segments 43 with the rotor core 42.

Figure 8:
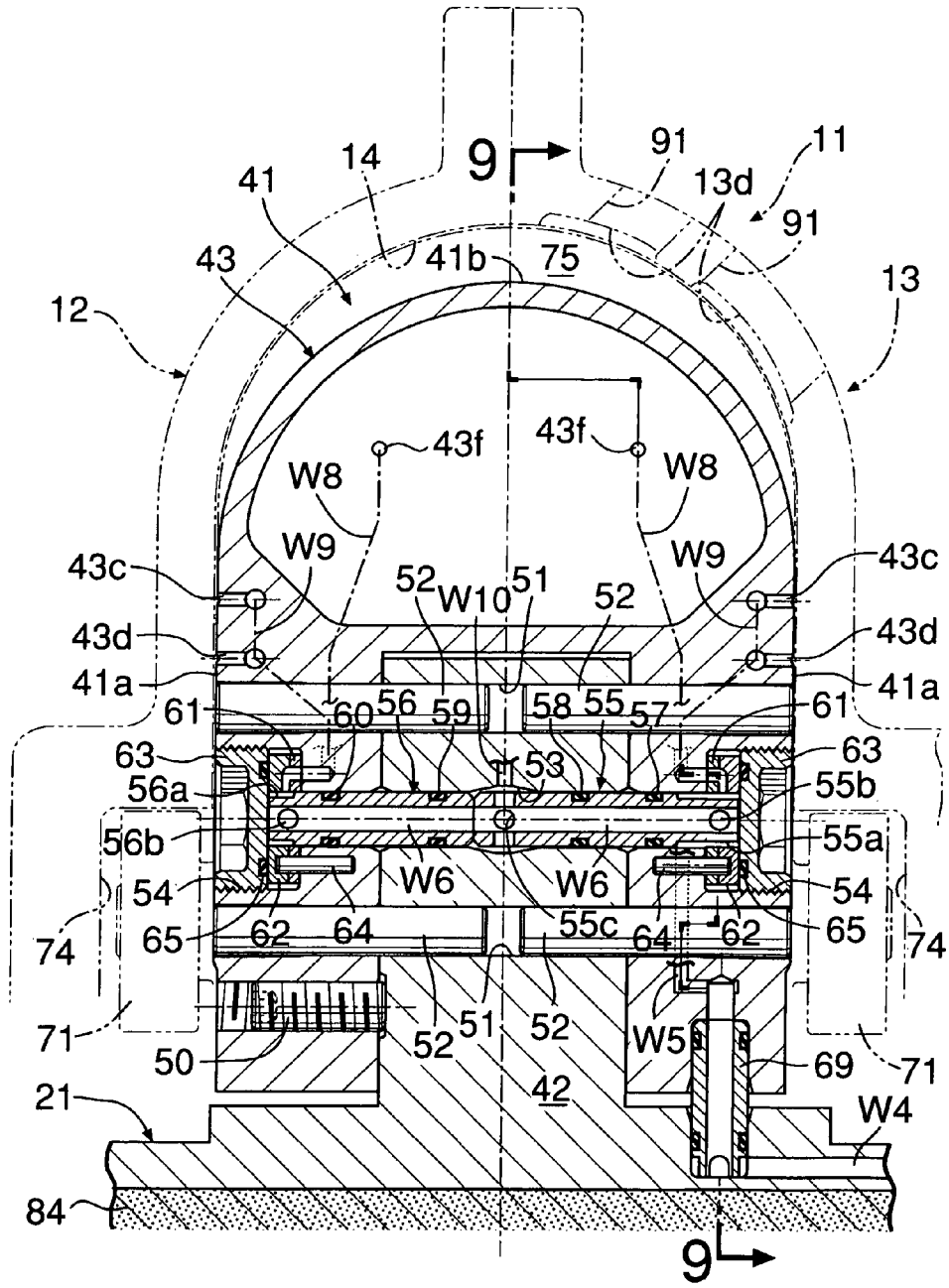
Figure 9:
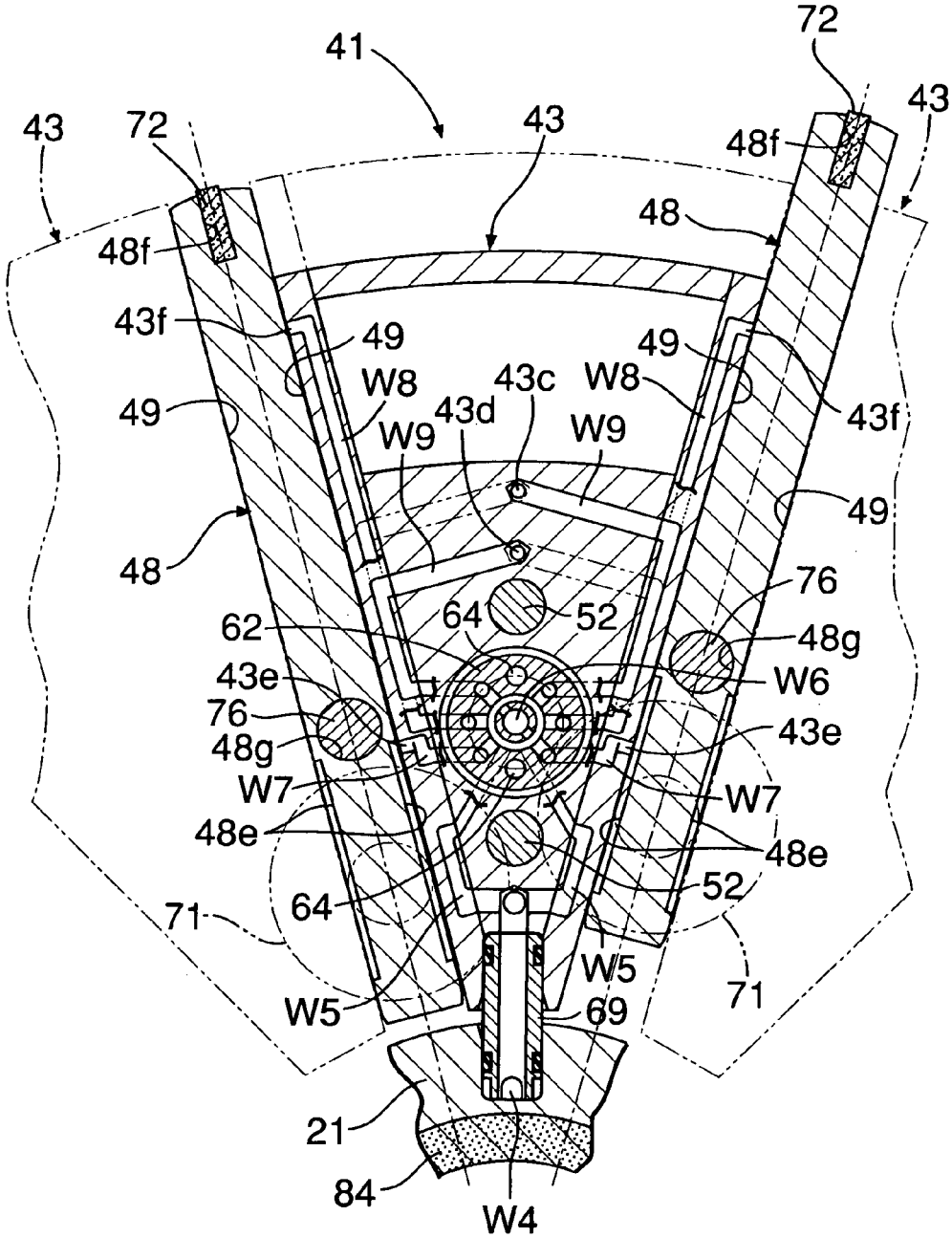
Figure 12:
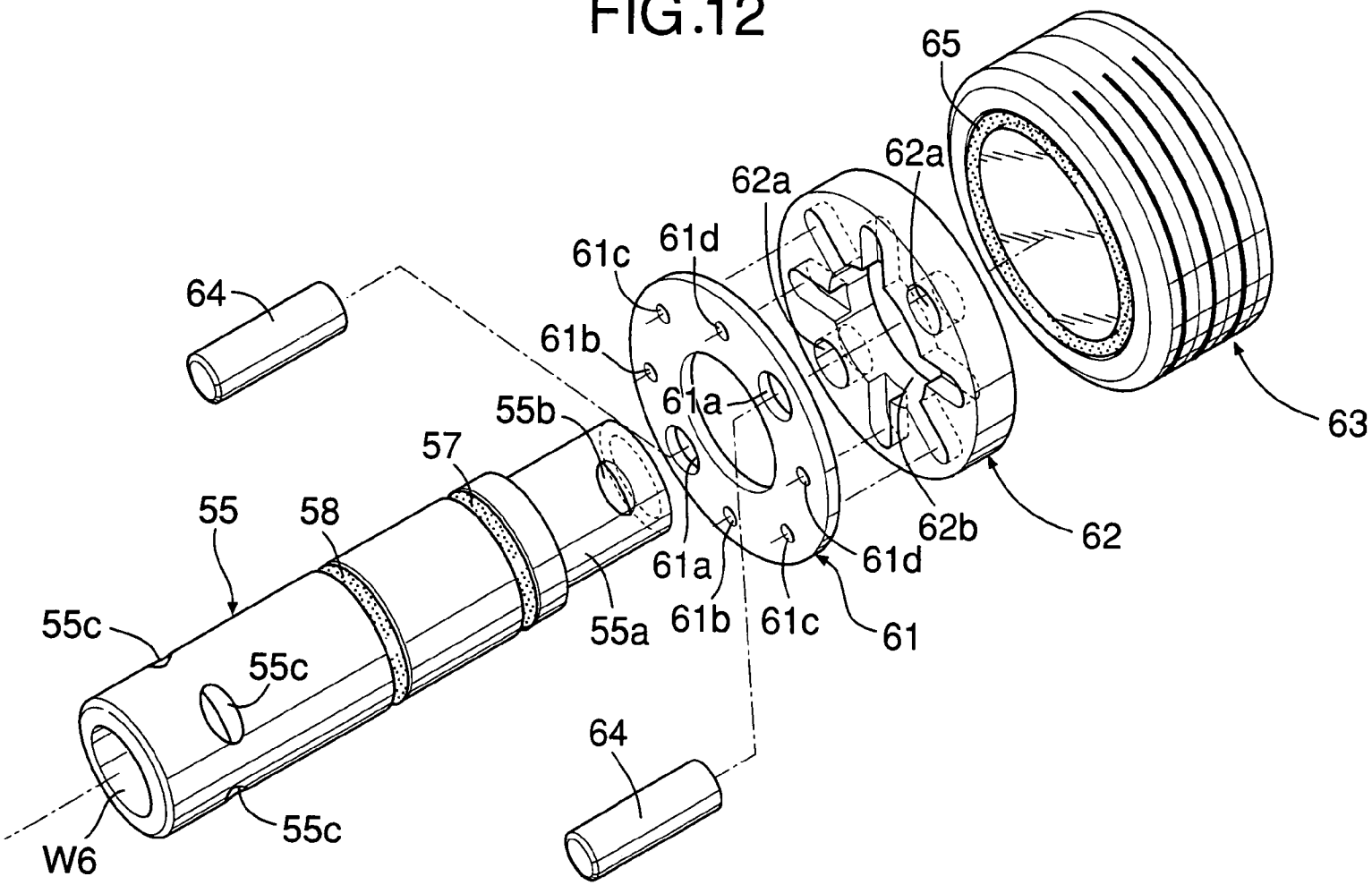

As is evident from FIG. 8, FIG. 9 and FIG. 12, a through hole 53 penetrating the rotor segments 43 and the rotor core 42 is formed between the two knock pin holes 51 and 51, and concaves 54 and 54 are formed at the opposite ends of the through hole 53. Two pipe members 55 and 56 are fitted into the through hole 53 with seal members 57 through 60, and an orifice forming plate 61 and a lubricating water distributing member 62 are fitted into the respective concaves 54 and fixed with nuts 63. The orifice forming plate 61 and the lubricating water distributing member 62 are prevented from turning relative to the rotor segments 43 by two knock pins 64 and 64 penetrating knock pin holes 61*a* and 61*a* in the orifice forming plate 61 and fitted into knock pin holes 62*a* and 62*a* in the lubricating water distributing member 62. Any space between the lubricating water distributing member 62 and the nut 63 is sealed with O rings 65.

A smaller diameter portion 55*a* formed at the outer end of one pipe member 55 communicates with a sixth water passage W6 within the pipe member 55 via a through hole 55*b*, and the smaller diameter portion 55*a* communicates with radial distributing grooves 62*b* formed in one side face of the lubricating water distributing member 62. The distributing grooves 62*b* in the lubricating water distributing member 62 extend in six directions, and their tip ends communicate with six orifices 61*b*, 61*b*; 61*c*, 61*c*; 61*d* and 61*d* in the orifice forming plate 61. The structures of the orifice forming plate 61, the lubricating water distributing member 62 and the nut 63 provided at the outer end of the other pipe member 56 are respectively the same as those of the orifice forming plate 61, the lubricating water distributing member 62 and the nuts 63 described above.

The two orifices 61*b* and 61*b* of the orifice forming plate 61 communicate on the downstream side with the lubricating water injection ports 43*e* and 43*e* opening to be opposite the vanes 48 via seventh water passages W7 and W7 formed within the rotor segments 43, two other orifices 61*c* and 61*c* communicate on the downstream side with the aforementioned two lubricating water injection ports 43*f* and 43*f* opening to be opposite the vanes 48 via eighth water passages W8 and W8 formed within the rotor segments 43, and the two still other orifices 61*d* and 61*d* communicate on the downstream side with the aforementioned two lubricating water injection ports 43*c* and 43*d* opening to be opposite the rotor chamber 14 via ninth water passages W9 and W9 formed within the rotor segments 43.

Figure 5:
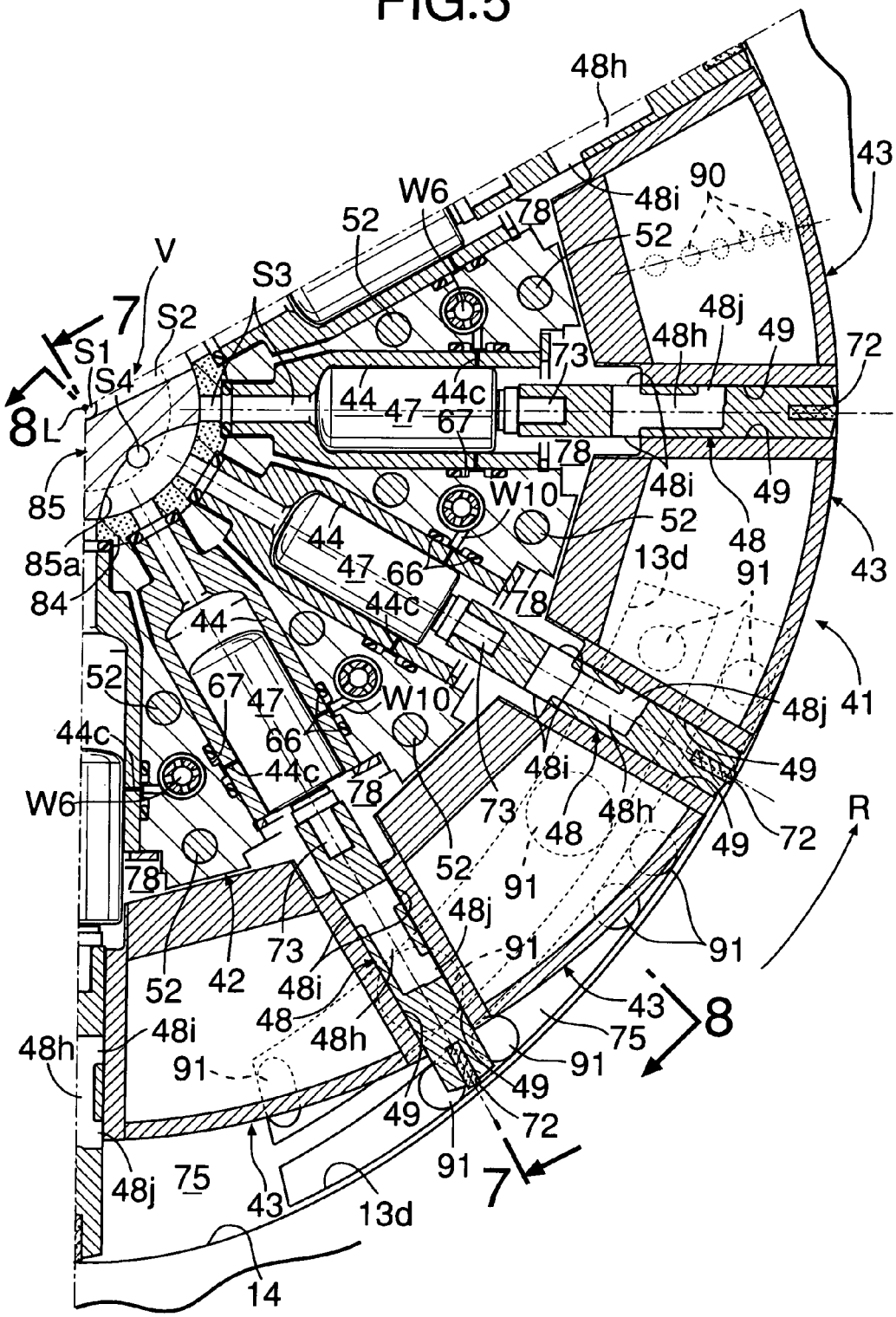
Figure 6:
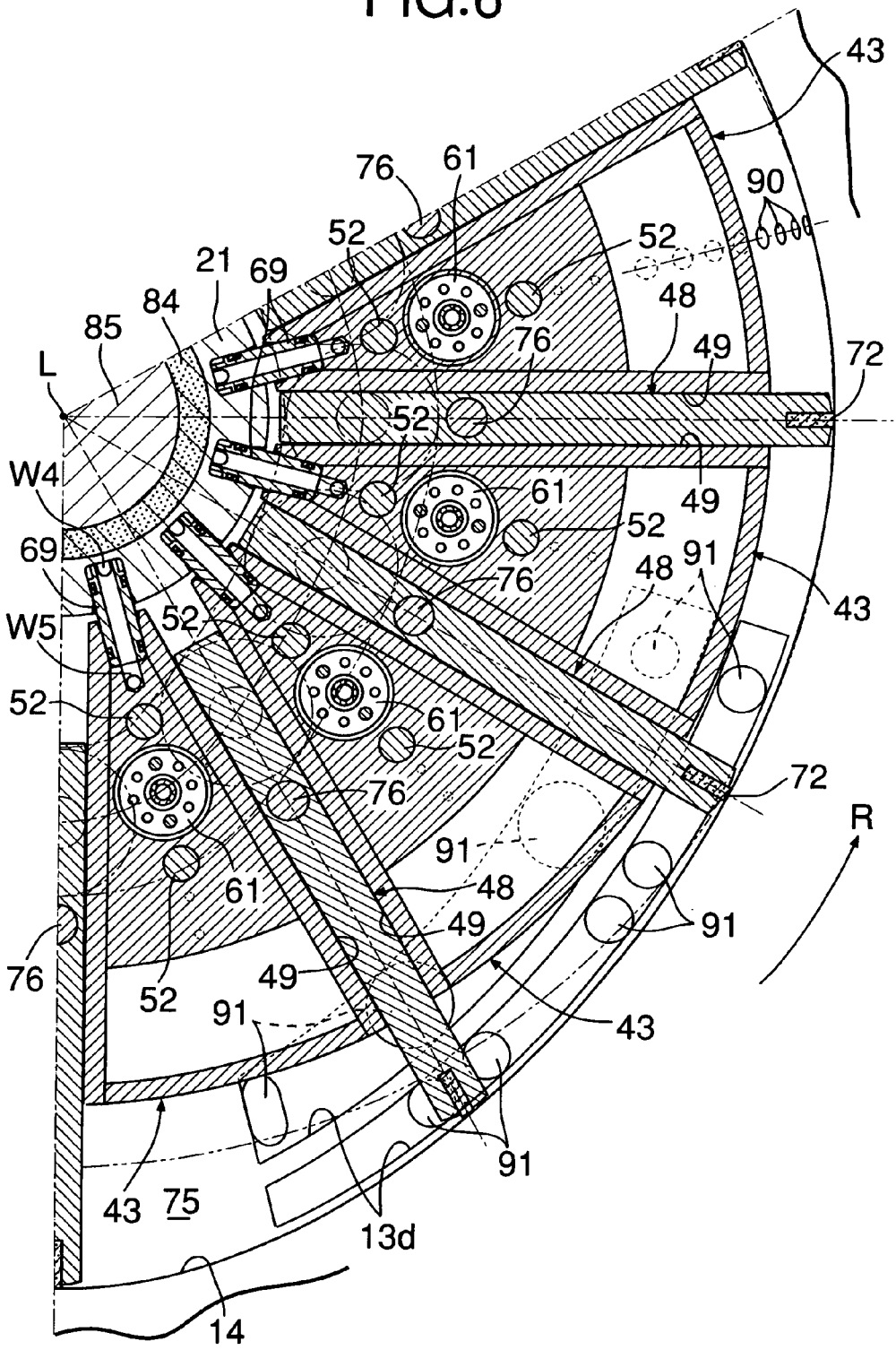
Figure 7:
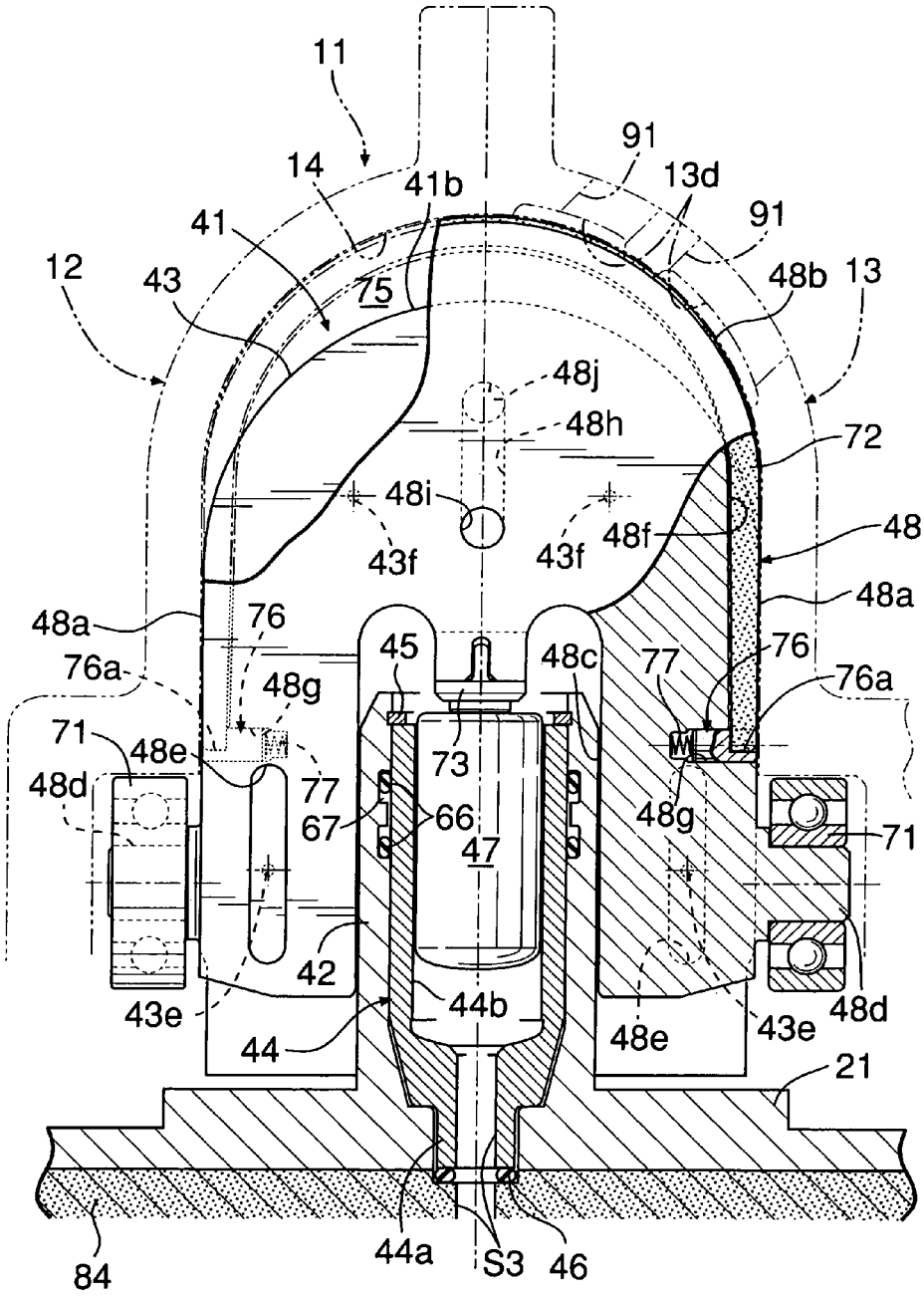

As is evident when FIG. 5 is referenced together, an annular groove 67 partitioned by the pair of O rings 66 and 66 is formed in the outer circumference of the cylinders 44, and the sixth water passage W6 formed in one pipe member 55 communicates with the annular groove 67 via four through holes 55*c* penetrating the pipe member 55 and a 10th water passage W10 formed within the rotor core 42. The annular groove 67 communicates with the sliding faces of the cylinder bore 44*b* and the piston 47 via the orifices 44*c*. The position of the orifice 44*c* in each cylinder 44 is set where it does not deviate from the sliding face of the piston 47 when the piston 47 moves between its top dead center and bottom dead center.

As is evident from FIG. 3 and FIG. 9, a first water passage W1 formed in the lubricating water guiding member 24 communicates with the smaller diameter portion 55*a* of the one pipe member 55, via second water passage W2 formed in the seal block 25, third water passages W3 formed in the smaller diameter portion 21*b* of the rotation shaft 21, an annular groove 68*a* formed in the outer circumference of a water passage forming member 68 fitted into the core of the rotation shaft 21, a fourth water passage W4 formed in the rotation shaft 21, a pipe member 69 provided astride over the rotor core 42 and the rotor segments 43, and fifth water passages W5 and W5 formed so as to detour a knock pin 52 inside the rotor segments 43 in the radial direction.

As shown in FIG. 5, FIG. 7, FIG. 9 and FIG. 11, twelve vane grooves 49 extending in radial directions are formed between adjoining rotor segments 43 of the rotor 41, and the plate-shaped vanes 48 are fitted into these vane grooves 49 to be slidable. Each of the vanes 48 is formed in a substantially U shape provided with parallel faces 48*a* and 48*a* positioned along the parallel faces 14*a* and 14*a* of the rotor chamber 14, an arcuate face 48*b* along an arcuate face 14*b* of the rotor chamber 14, and a notch 48*c* positioned between the two parallel faces 48*a* and 48*a*, and rollers 71 and 71 each having a roller bearing structure are rotatably supported by a pair of spindles 48*d* and 48*d* protruding from the two parallel faces 48*a* and 48*a*.

Figure 13:
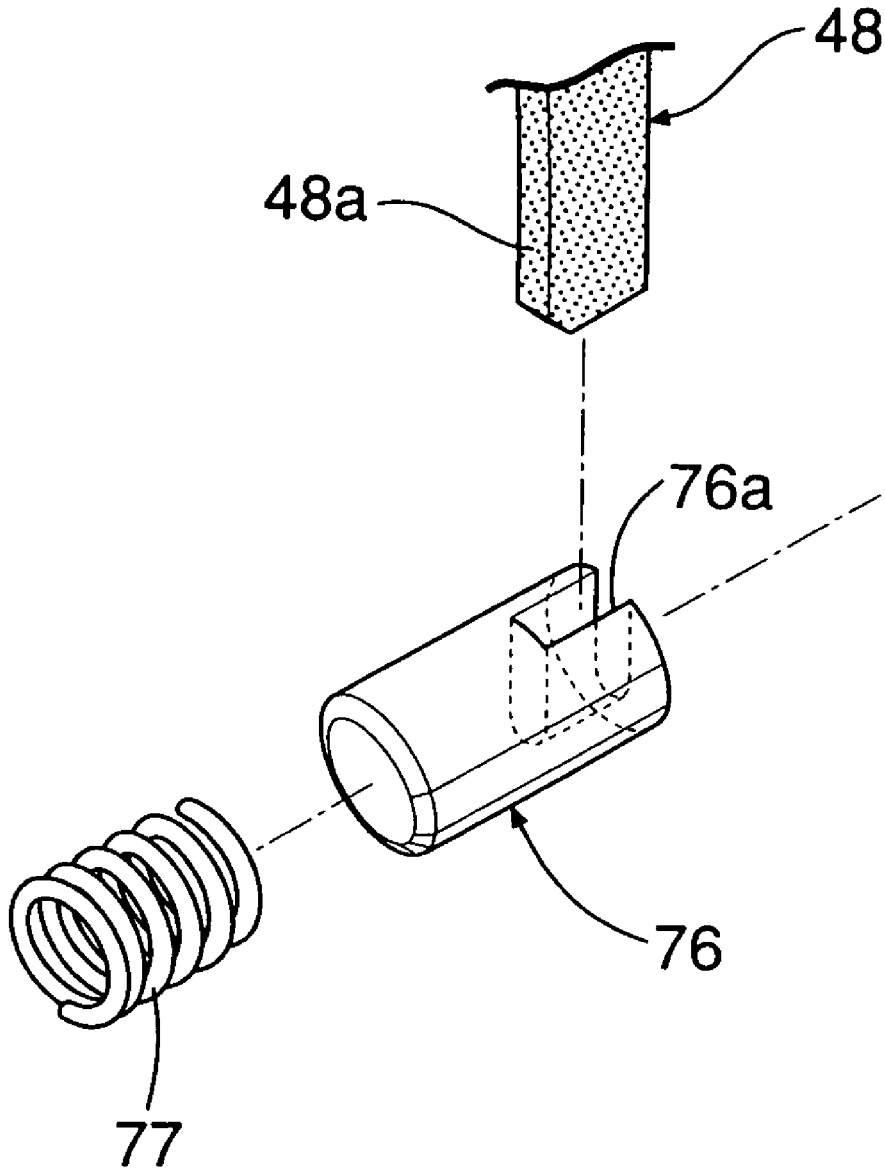

Slit-shaped seal holding grooves 48*f* are formed from the arcuate face 48*b* of each vane 48 to the pair of the parallel faces 48*a* and 48*a*. Each of these seal holding grooves 48*f* holds a synthetic resin-made vane seal 72 formed in a U shape, and the tip of this vane seal 72 slightly protrudes from the outer circumferential face of the vane 48 to come into sliding contact with the inner circumferential face of the rotor chamber 14. Engaging holes 48*g* and 48*g* having a circular section communicating with the inner ends of the seal holding grooves 48*f* in the radial direction are formed in the direction of the axis L in the pair of parallel faces 48*a* and 48*a* of the vane, and cylindrical seal ancillary members 76 and 76 are fitted into these engaging holes 48*g* and 48*g* with no gaps therebetween. As is evident from FIG. 13, slits 76*a* and 76*a* opening outward in the radial directions and outward in the axial direction are formed in the seal ancillary members 76 and 76, and the inner ends of the vane seals 72 in the radial direction are fitted into these slits 76*a* and 76*a* with no gaps therebetween. The seal ancillary members 76 and 76 are pressed outward in the direction of the axis L (the direction of protruding out of the engaging holes 48*g* and 48*g*) by springs 77 and 77 arranged on the bottoms of the engaging holes 48*g* and 48*g*.

Formed on the opposite sides of each vane 48 are two recesses 48*e* and 48*e*, and these recesses 48*e* and 48*e* are opposite the two lubricating water injection ports 43*e* and 43*e* inside in the radial direction, opening in the end faces of the rotor segments 43. Formed within the vane 48 is a trap chamber 48*h* extending in the radially inward and outward directions; the inside of the trap chamber 48*h* in the radial direction communicates, via suction ports 48*i* and 48*i* opening in the two sides of the vane 48, with a reservoir 78 formed between the rotor core 42 and the rotor segments 43, and the outside of the trap chamber 48*h* in the radial direction communicates, via an exhaust port 48*j* opening in the forward side face of the vane 48 in the rotational direction R, with the vane chamber 75. A piston bearing member 73 protruding at the center of the notch 48*c* in the vane 48 in the radially inward direction comes into contact with the outer end of the piston 47 in the radial direction.

As is evident from FIG. 2, the reservoir 78 formed between the rotor core 42 and the rotor segments 43 and the junction chamber 19 are made communicable with each other by a communicating hole 12*d* penetrating the first casing 12, and a one-way valve 79 permitting the shift of steam from the reservoir 78 to the junction chamber 19 and restricting the shift of steam from the junction chamber 19 to the reservoir 78 is arranged in this communicating hole 12*d*.

As is evident from FIG. 4, pseudo-oval annular grooves 74 and 74 resembling diamonds with the four corners rounded are provided in the flat faces 14*a* and 14*a* of the rotor chamber 14 partitioned by the first and second casing halves 12 and 13, and the pair of rollers 71 and 71 of each vane 48 engage to be able to roll in the two annular grooves 74 and 74. The distance between these annular grooves 74 and the arcuate faces 14*b* of the rotor chamber 14 is constant over the entire circumference. Therefore, when the rotor 41 turns, the vanes 48, whose rollers 71 and 71 are guided by the annular grooves 74 and 74, reciprocate in the radial direction within the vane grooves 49 and, in a state in which the vane seal 72 mounted to the arcuate face 48*b* of each vane 48 is compressed to a certain amount, slide along the arcuate faces 14*b* of the rotor chamber 14. This results in preventing the rotor chamber 14 and the vanes 48 from coming into direct solid contact, and makes it possible to reliably seal the vane chambers 75 partitioned by the adjoining vanes 48 while preventing an increase in frictional resistance and the occurrence of wear.

Figure 10:
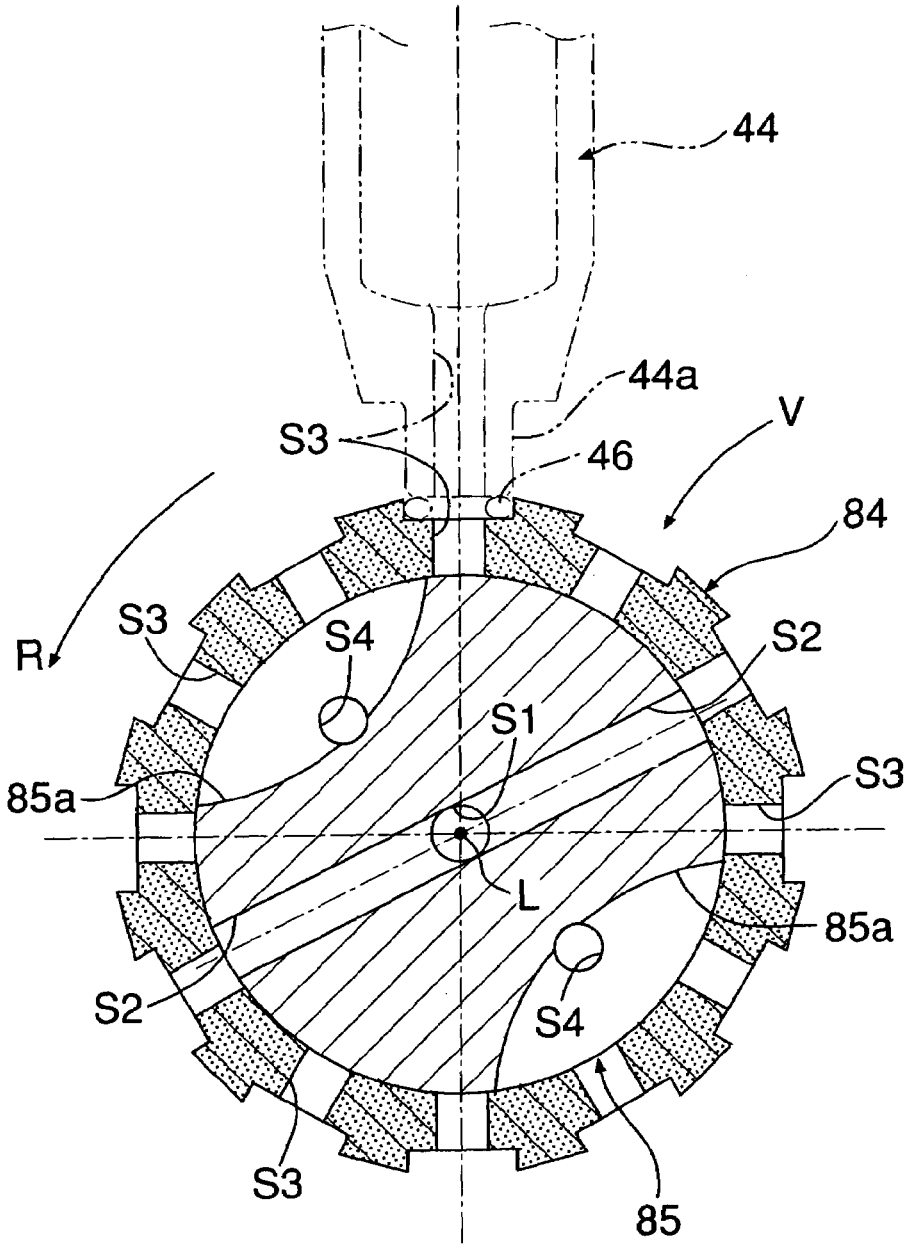
Figure 11:
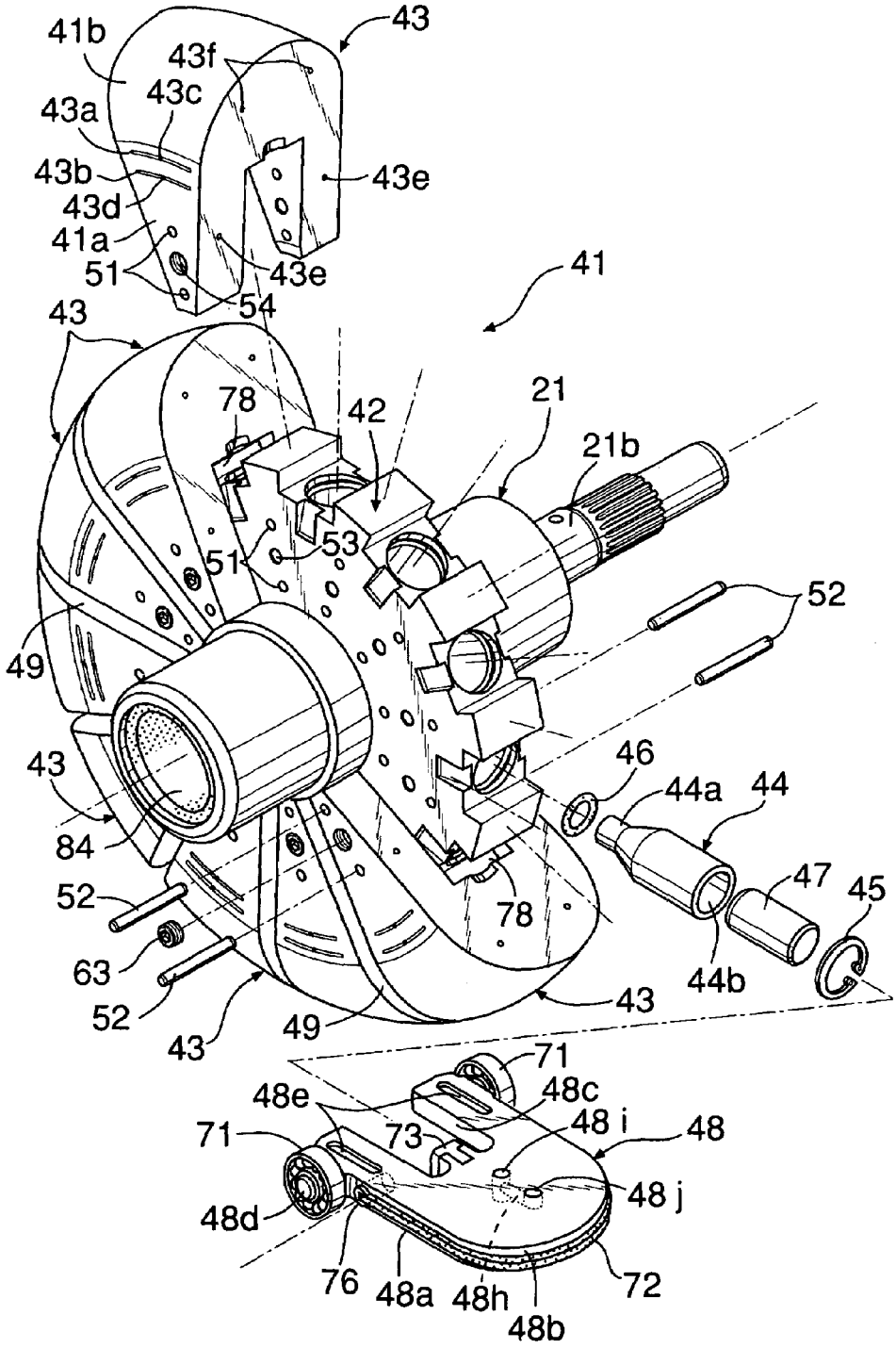

As is evident from FIG. 2, FIG. 3 and FIG. 10, an aperture 16*b* is formed at the center of the junction chamber outer wall 16, and a boss portion 81*a* of a fixed shaft supporting member 81 arranged on the axis L is fixed to the inner face of the aperture 16*b* with a plurality of bolts 82 and further fixed to the first casing half 12 with a nut 83. The ceramic cylindrical sleeve 84 is fixed to the hollow part 21*a* of the rotation shaft 21, and the outer circumferential face of a fixed shaft 85 integral with the fixed shaft supporting member 81 is fitted onto the inner circumferential face of this sleeve 84 to be rotatable in a relative manner. Any space between the left end of the fixed shaft 85 and the first casing half 12 is sealed by a seal member 86, while any space between the right end of the fixed shaft 85 and the rotation shaft 21 is sealed by a seal member 87.

A steam feed pipe 88 is fitted into the fixed shaft supporting member 81 arranged on the axis L and fixed with a nut 89, and the right end of this steam feed pipe 88 is pressed into the core of the fixed shaft 85. The first steam passages S1 communicating with the steam feed pipe 88 is formed in the axial direction at the core of the fixed shaft 85, and the pair of second steam passages S2 and S2 penetrate the fixed shaft 85 in the radial direction with a phase difference of 180°. As stated above, the twelve third steam passages S3 penetrate the sleeve 84 and the smaller diameter portions 44*a* of the 12 cylinders 44 held at 30° intervals by the rotor 41 fixed to the rotation shaft 21, and the inner ends of these third steam passages S3 in the radial direction are communicatably opposite the outer ends of the second steam passages S2 and S2 in the radial direction.

A pair of notches 85*a* and 85*a* are formed in the outer circumferential face of the fixed shaft 85 with a phase difference of 180°, and these notches 85*a* and 85*a* are communicatable with the third steam passages S3. The notches 85*a* and 85*a* and the junction chamber 19 communicate with each other via a pair of fourth steam passages S4 and S4 formed in the fixed shaft 85 in the axial direction, an annular fifth steam passage S5 formed in the fixed shaft supporting member 81 in the axial direction, and through holes 81*b* opening in the outer circumference of the boss portion 81*a* of the fixed shaft supporting member 81.

As shown in FIG. 2 and FIG. 4, a plurality of air intake ports 90 aligned in radial directions are formed in the first casing half 12 and the second casing half 13 in 15° forward positions in the rotational direction R of the rotor 41 with reference to the direction of the shorter axis of the rotor chamber 14. These air intake ports 90 make the internal space of the rotor chamber 14 communicate with the junction chamber 19. In the second casing half 13 are formed a plurality of exhaust ports 91 in 15° to 75° backward positions in the rotational direction R of the rotor 41 with reference to the direction of the shorter axis of the rotor chamber 14. These exhaust ports 91 make the internal space of the rotor chamber 14 communicate with the exhaust chamber 20. In order that the vane seals 72 of the vanes 48 may not be damaged by the edges of the exhaust ports 91, those exhaust ports 91 open into shallow concaves 13*d* and 13*d* formed inside the second casing half 13.

The second steam passages S2 and S2, the third steam passages S3 the notches 85*a* and 85*a* of the fixed shaft 85 and the third steam passages S3 constitute a rotary valve V which is periodically made communicable by the relative rotations of the fixed shaft 85 and the rotation shaft 21 (see FIG. 10).

As is evident from FIG. 2, an 11th water passage W11 formed in the first and second casing halves 12 and 13 communicates with the outer circumferential face of the annular filter 30 via a 14th water passage W14 comprising a pipe, and the inner circumferential face of the filter 30 communicates with a 16th water passage W16 formed in the second casing half 13 via a 15th water passage W15 formed in the second casing half 13. Water fed to the 16th water passage W16 lubricates the sliding faces of the fixed shaft 85 and the sleeve 84. Water fed from the inner circumferential face of the filter 30 to the outer circumference of the bearing member 23 via a 17th water passage W17 lubricates the outer circumferential face of the rotation shaft 21 through an orifice penetrating the bearing member 23. On the other hand, water fed from the 11th water passage W11 to the outer circumference of the bearing member 22 via an 18th water passage W18 comprising a pipe, after lubricating the outer circumferential face of the rotation shaft 21 through an orifice penetrating the bearing member 22, lubricates the sliding faces of the fixed shaft 85 and the sleeve 84.

Next will be described the operations of this embodiment of the invention configured as described above.

First will be described the operation of the expander 4. With reference to FIG. 3, high temperature high pressure steam from the evaporator 3 is fed to the steam feed pipe 88, the first steam passage S1 penetrating the core of the fixed shaft 85, and the pair of second steam passages S2 and S2 penetrating the fixed shaft 85 in the radial direction. Referring to FIG. 10, when the sleeve 84 rotating integrally with the rotor 41 and the rotation shaft 21 in the direction of arrow R reaches a predetermined phase relative to the fixed shaft 85, the pair of third steam passages S3 and S3 in a forward position in the rotational direction R of the rotor 41 from the position of the shorter diameter of the rotor chamber 14 come to communicate with the pair of second steam passages S2 and S2, and the high temperature high pressure steam of the second steam passages S2 and S2 is fed into the insides of the pair of cylinders 44 and 44 via the third steam passages S3 and S3, and presses the pistons 47 and 47 outward in the radial directions. Referring to FIG. 4, when the vanes 48 and 48 pressed by these pistons 47 and 47 move outward in the radial direction, engagement between the pair of rollers 71 provided on the vanes 48 and the annular grooves 74 and 74 converts the forward movements of the pistons 47 and 47 into a rotational movement of the rotor 41.

Even after the communication between the second steam passages S2 and S2 and the third steam passages S3 and S3 is cut off due to the rotation of the rotor 41, the high temperature high pressure steam in the cylinders 44 and 44 continues to expand and causes the pistons 47 and 47 to move farther forward, thereby continuing the rotation of the rotor 41. When the vanes 48 and 48 reaches the position of the longer diameter of the rotor chamber 14, the third steam passages S3 and S3 communicating with the respectively corresponding cylinders 44 and 44 come to communicate with the notches 85*a* and 85*a* of the fixed shaft 85, and the pistons 47 and 47 pressed by the vanes 48 and 48 whose rollers 71 and 71 are guided by the annular grooves 74 and 74 moves in the radially inward direction and causes steam in the cylinders 44 and 44 to pass through the third steam passages S3 and S3, the notches 85*a* and 85*a*, the fourth steam passages S4 and S4, the fifth steam passage S5 and the through holes 81*b* to become first reduced temperature reduced pressure steam, which is fed to the junction chamber 19. The first reduced temperature reduced pressure steam results from the temperature and pressure reduction of the high temperature high pressure steam fed from the steam feed pipe 88 and having finished the work to drive the pistons 47 and 47. The thermal energy and pressure energy of the first reduced temperature reduced pressure steam are still sufficient to drive the vanes 48, though weaker than those of the high temperature high pressure steam.

The first reduced temperature reduced pressure steam in the junction chamber 19 is fed from the air intake ports 90 of the first and second casing halves 12 and 13 to the vane chambers 75 within the rotor chamber 14, where it further expands to press the vanes 48 thereby to turn the rotor 41. The second reduced temperature reduced pressure steam having finished its task to have lowered temperature and pressure is discharged from the exhaust ports 91 of the second casing half 13 into the exhaust chamber 20 and fed from there to the condenser 5.

As the twelve pistons 47 are successively actuated by the expansion of high temperature high pressure steam in this way to turn the rotor 41 via the rollers 71 and 71 and the annular grooves 74 and 74, and the rotor 41 is turned via the vanes 48 by the expansion of the first reduced temperature reduced pressure steam resulting from a decrease in temperature and pressure of the high temperature high pressure steam, it is possible to integrate mechanical energy generated by the pistons 47 and mechanical energy generated by the vanes 48 to obtain an output from the rotation shaft 21 and, moreover, the pressure energy of the high temperature high pressure steam can be completely converted into mechanical energy.

Further, as first energy converting means is composed of the cylinders 44 radially formed in the rotor 41 rotatably accommodated within the rotor chamber 14 and the pistons 47 sliding inside these cylinders 44, it is made possible to minimize the efficiency drop due to leaks by enhancing the sealing performance of the high temperature high pressure gaseous phase working medium. Also, as second energy converting means is composed of the vanes 48 supported by the rotor 41 to be movable in the radial directions and being in sliding contact with the inner circumferential face of the rotor chamber 14, the structure of the mechanism to convert pressure energy into mechanical energy is simple, thereby processing a large quantity of gaseous phase working medium in spite of the compact structure. Moreover, the combination of the first energy converting means having the cylinders 44 and the pistons 47 with the second energy converting means having the vanes 48 results in a high performance rotating fluid machine having the features of the both.

Next will be described the aforementioned lubrication of the vanes 48 and the pistons 47 of the expander 4 with water.

For lubricating each part of the expander 4, there is used high temperature water distributed by the distributing valve 106 to the passage P6 after being heated by the water jacket 105.

Referring to FIG. 3 and FIG. 8, water supplied to the first water passage W1 of the lubricating water guiding member 24 flows into the smaller diameter portion 55*a* of the one pipe member 55 via the second water passage W2 of the seal block 25, the third water passages W3 of the rotation shaft 21, the annular groove 68*a* of the water passage forming member 68, the fourth water passage W4 of the rotation shaft 21, the pipe member 69, and the fifth water passages W5 and W5 formed in the rotor segments 43. Water fed into the smaller diameter portion 55*a* flows into a smaller diameter portion 56*a* of the other pipe member 56 via the through hole 55*b* in the one pipe member 55, the sixth water passage W6 formed in the two pipe members 55 and 56, and a through hole 56*b* formed in the other pipe member 56.

Water from the respective smaller diameter portions 55*a* and 56*a* of the pipe members 55 and 56 passes through the six orifices 61*b*, 61*b*; 61*c*, 61*c*; 61*d* and 61*d* in the orifice forming plate 61 via the distributing grooves 62*b* of the lubricating water distributing member 62, one part of the water is injected out of the four lubricating water injection ports 43*e*, 43*e*; 43*f*, 43*f* opening in the end faces of the rotor segments 43, and the other part is injected out of the lubricating water injection ports 43*c* and 43*d* in the arcuate recesses 43*a* and 43*b* formed on side faces of the rotor segments 43.

Then, the water injected out of the lubricating water injection ports 43*e*, 43*e*; 43*f*, 43*f* of the respective end faces of the rotor segments 43 into the vane grooves 49 constitutes a static pressure bearing between the vane grooves 49 and the vanes 48 slidably fitted into the vane grooves 49 to support the vanes 48 in a floating state, and prevents static contact between the end faces of the rotor segments 43 and the vanes 48 thereby to prevent seizure and wear from occurring. By supplying water to lubricate the sliding faces of the vanes 48 via water passages arranged radially within the rotor 41, not only can the water be pressurized by a centrifugal force but also the impact of thermal expansion is reduced by stabilizing the temperature around the rotor 41 and steam leakage is minimized by maintaining the preset clearances.

Further, as water is held by the two recesses 48*e* and 48*e* formed in each of the opposite faces of the vanes 48, these recesses 48*e* and 48*e* serve as pressure reservoirs to reduce a pressure drop due to water leakage. As a result, the vanes 48 positioned between the end faces of the pair of rotor segments 43 and 43 are kept in a floating state by the water, and the frictional resistance can be effectively reduced. Although the reciprocation of the vanes 48 varies the positions of the vanes 48 relative to the rotor 41 in the radial direction, the reciprocating vanes 48 are held in a floating state all the time to enable an effective reduction in frictional resistance, because the recesses 48*e* and 48*e* are arranged not on the rotor segment 43 side but on the vane 48 side and disposed near the rollers 71 and 71, where the load on the vanes 48 is the greatest.

When the individual vanes 48 turn together with the rotor 41, the vane seal 72 fitted into the seal holding grooves 48*f* are pressed by a centrifugal force outward in the radial direction, and this causes the vane seal 72 to be pressed against the inner circumferential face of the rotor chamber 14 in the portions of the vanes 48 matching the arcuate face 48*b*, thereby exhibiting a sealing performance. Although no pressing force of the vane seal 72 due to a centrifugal force can be expected in the portions of the vanes 48 matching the parallel faces 48*a* and 48*a*, the pressure introduced from the vane chamber 75 into the bottom part of the seal holding grooves 48*f* of the vanes 48 presses the vane seal 72 in the direction of being thrust out of the seal holding grooves 48*f*, so that the whole area of the outer circumferential face of the vane seal 72 is pressed against the inner circumferential face of the rotor chamber 14, thereby exhibiting a sealing performance.

In this process, if the pressure escapes from the opposite ends of the seal holding grooves 48*f*, the pressing force of the vane seal 72 will generally disappear, but in this embodiment, the ends of the vane seal 72 are fitted into the slits 76*a* and 76*a* of the seal ancillary members 76 and 76 which are fitted into the engaging holes 48*g* and 48*g* communicating with the opposite ends of the seal holding grooves 48*f*, the slits 76*a* and 76*a* of the seal ancillary members 76 and 76 open outward in the radial direction and close inward in the radial direction, and the outer end faces of the seal ancillary members 76 and 76 in the direction of the axis L where the slits 76*a* and 76*a* open are pressed by the urging forces of the springs 77 and 77 toward the inner circumferential face of the rotor chamber 14, resulting in that the ends of the vane seal 72 are stuck tightly to the slits 76*a* and 76*a* of the seal ancillary members 76 and 76, whereby the sealing performance of the vane seal 72 can be ensured by preventing pressure from escaping out of the opposite ends of the seal holding grooves 48*f*.

Especially when the expander 4 is cold and the pressure in the bottom part of the seal holding grooves 48*f* does not sufficiently rise, the sealing performance can be secured by causing the urging forces of the springs 77 and 77 to press the seal ancillary members 76 and 76 and the ends of the vane seal 72 against the inner circumferential face of the rotor chamber 14.

Further with reference to FIG. 5, water fed from the sixth water passage W6 within the pipe members 55 to the sliding faces of the cylinders 44 and the pistons 47 via a 10th water passage W10 within the rotor segments 43 and the annular grooves 67 in the outer circumferences of the cylinders 44 performs a sealing performance by virtue of the viscosity of the water film formed on those sliding faces, and effectively prevents the high temperature high pressure steam supplied to the cylinders 44 from leaking through space between their sliding faces and the pistons 47. As water then supplied through the inside of the expander 4, which is in a high temperature state, to the sliding faces of the cylinders 44 and the pistons 47 is heated, the high temperature high pressure steam supplied to the cylinders 44 is cooled by that water, making it possible to minimize the output drop of the expander 4.

Further, the first water passage W1 and the 11th water passage W11 are independent of each other, and supply water under the pressure required by each part to be lubricated. More specifically, since the water supplied from the first water passage W1 mainly supports the vanes 48 and the rotor 41 in a floating state by a static pressure bearing, it needs a pressure high enough to be able to antagonize load variations. Unlike that, as the water supplied from the 11th water passage W11 mainly lubricates the surroundings of the fixed shaft 85 and seals the high temperature high pressure steam leaking from the third steam passages S3 and S3 to the outer circumference of the fixed shaft 85 to thereby reduce the effects of the thermal expansion of the fixed shaft 85, the rotation shaft 21, the rotor 41 and the like, the water merely needs a pressure at least higher than that in the junction chamber 19.

As described above, there are thus provided two water feed lines including the first water passage W1 for supplying high pressure water and the 11th water passage W11 for supplying water of a lower pressure than that, which eliminate the problems in the case where only one water feed line is provided. Thus, it is possible to prevent the flow rate of water to the junction chamber 19 from being increased by the supply of water under excessive pressure to the surroundings of the fixed shaft 85 and the steam temperature from being lowered by excessive cooling of the fixed shaft 85, the rotation shaft 21, the rotor 41 and so forth, and thus to raise the output of the expander 4 while reducing the quantity of water supply.

Moreover, since water, which is the same substance as steam, is used as the sealing medium, no problem will arise even if the water gets mixed with steam. If the sliding faces of the cylinders 44 and the pistons 47 were sealed with oil, the oil would inevitably get mixed with water or steam, so that a special filtering device to separate the oil is required. Also, as part of the water for lubricating the sliding faces of the vanes 48 and the vane grooves 49 is bypassed to be diverted for sealing the sliding faces of the cylinders 44 and the pistons 47, there is no need to separately provide water passages to guide that water to the sliding faces, so that the structure can be simplified.

The liquid phase working medium supplied to the sliding faces of the vanes 48 and the vane grooves 49 to constitutes the static pressure bearings resides in the reservoir 78 formed between the rotor core 42 and the rotor segments 43 after having completed its role. Since the annular grooves 74 and 74 provided in the vanes 48 to guide the rollers 71 and 71 communicate with this reservoir 78, the liquid phase working medium having flowed into the annular grooves 74 and 74 generates a great resistance when the rollers 71 and 71 shift, which might invite a drop in the output of the expander 4.

However, in this embodiment, the liquid phase working medium in the reservoir 78 can be discharged to the exhaust ports 91 via the vane chamber 75 by the function of the trap chambers 48*h* provided on the vanes 48. That is, as shown on the right side of FIG. 5, when the vanes 48 have retreated deepest inside the vane grooves 49, the suction ports 48*i* and 48*i* communicating with the inner ends of the trap chambers 48*h* in the radial direction communicate with the reservoir 78, and cause the liquid phase working medium in the reservoir 78 to be trapped by the trap chambers 48*h*. When the rotor 41 turns in the direction of arrow R, the vanes 48 protrude outside the vane grooves 49 in the radial direction as shown in the lower side of FIG. 5, and the exhaust ports 48*j* communicating with the outer ends of the trap chambers 48*h* in the radial direction communicate with the vane chamber 75 in the exhaust stroke, and cause the liquid phase working medium trapped by the trap chambers 48*h* to be discharged into the vane chamber 75.

Along with the rotation of the rotor 41 in the direction of arrow R in this way, the trap chamber 48*h* provided in each of the vanes 48 causes the liquid phase working medium in the reservoir 78 to be discharged into the vane chamber 75 to prevent the rotation of the rotor 41 from being braked by the resistance of the liquid phase working medium resided in the reservoir 78. Moreover, when the suction ports 48*i* and 48*i* communicate with the reservoir 78, the exhaust port 48*j* does not communicate with the vane chamber 75, and when the exhaust port 48*j* communicates with the vane chamber 75, the suction ports 48*i* and 48*i* do not communicate with the reservoir 78, in other words, the suction ports 48*i* and 48*i* and the exhaust port 48*j* never communicate with the reservoir 78 and the vane chamber 75 at the same time. Therefore, the high temperature high pressure steam with pressure energy having leaked out of the sliding faces of the cylinders 44 and the pistons 47 and trapped by the reservoir 78 is never wastefully discarded into the vane chamber 75 via the trap chamber 48*h*.

Further, since the high temperature high pressure steam with pressure energy having leaked out of the sliding faces of the cylinders 44 and the pistons 47 and trapped by the reservoir 78 is supplied to the junction chamber 19 via the communicating hole 12*d* of the first casing 12 and the one-way valve 79 (see FIG. 2), the high temperature high pressure steam can be fed from the air intake ports 90 to the vane chambers 75 for effective reuse. If the pressure in the reservoir 78 drops below that in the junction chamber 19 for some reason, the one-way valve 79 closes to prevent reduced temperature reduced pressure steam in the junction chamber 19 from flowing back to the reservoir 78. Therefore, it is possible to obstruct pressure from escaping out of the junction chamber 19, thereby preventing the efficiency of the expander 4 from deteriorating.

Next will be described the operation of the cooling system of the internal combustion engine 1 including the waste heat recovery device 2 mainly with reference to FIG. 1 and FIG. 2.

Water drawn up from the tank 6 by the low pressure pump 7 is fed to the heat exchanger 102 provided in the exhaust pipe 101 via the passage P1 and, after being preheated there, is fed to the water jacket 105 of the internal combustion engine 1 via the passage P2. Water flowing within the water jacket 105 cools the cylinder blocks 103 and the cylinder heads 104, which are the heat generating parts of the internal combustion engine 1, and fed to the distributing valve 106 in a state of being raised in temperature. As water preheated by the heat exchanger 102 of the exhaust pipe 101 is fed to the water jacket 105, when the internal combustion engine 1 is at low temperature, its warming-up can be accelerated, and the performance of the evaporator 3 can be enhanced by preventing the internal combustion engine 1 from being excessively cooled to raise its exhaust gas temperature.

Part of the high temperature water distributed by the distributing valve 106 is pressurized by the high pressure pump 8 provided on the passage P4 and fed to the evaporator 3, where it exchanges heat with exhaust gas to become high temperature high pressure steam. The high temperature high pressure steam generated by the evaporator 3 is fed to the steam feed pipe 88 of the expander 4 and, after passing by the cylinders 44 and the vane chambers 75 to drive the rotation shaft 21, is discharged into the condenser 5.

Another part of the high temperature water distributed by the distributing valve 106 is reduced in pressure by the reducing valve 107 provided on the passage P5 to become steam, which is fed to the junction chamber 19 of the expander 4. The steam fed to the junction chamber 19 joins the first reduced temperature reduced pressure steam fed from the steam feed pipe 88 and having passed by the cylinders 44 and, after driving the rotation shaft 21, is discharged to the condenser 5. As part of the high temperature water from the distributing valve 106 is vaporized by the reducing valve 107 and fed to the expander 4 in this way, the thermal energy that the water has received from the water jacket 105 of the internal combustion engine 1 can be effectively utilized to boost the output of the expander 4. Also, still another part of the high temperature water distributed by the distributing valve 106 is fed to the first water passage W1 of the expander 4 via the passage P6 and lubricates various parts to be lubricated. As the parts to be lubricated of the expander 4 are thus lubricated by using high temperature water, it is possible to prevent the expander 4 from being excessively cooled thereby reducing so-called cooling loss. Further, the water having entered after lubrication into the vane chambers 75 in the expansion stroke is heated and vaporized by being mixed with steam in the vane chambers 75, and its expansion effect boosts the output of the expander 4. Then, the second reduced temperature reduced pressure steam discharged from the expander 4 to the passage P8 is fed to the condenser 5, and cooled there by the cooling fan 109 to become water, which is returned to the tank 6. Still another part of the high temperature water distributed by the distributing valve 106, after being cooled by heat exchanging with the auxiliaries 110 provided on the passage P7, is returned to the tank 6 via the check valve 111.

As described above, a water circulating route by which, after feeding the water jacket 105 with water drawn up from the tank 6 by the low pressure pump 7 to cool the heat generating part of the internal combustion engine 1, the water is returned to the tank 6 after being fed to the auxiliaries 110 to be cooled, and a water circulating route of the waste heat recovery device 2 by which part of water having come out of the water jacket 105 is distributed as the working medium and the water is returned to the tank 6 via the high pressure pump 8, the evaporator 3, the expander 4 and the condenser 5 are combined, and the water circulating route of the cooling system for the internal combustion engine 1 passing through the water jacket 105 and the auxiliaries 110 is provided with a low pressure and a high flow rate, while the water circulating route of the waste heat recovery device 2 is provided with a high pressure and a low flow rate. Therefore, it is possible to supply water at respectively suitable flow rates and pressures to the cooling system of the internal combustion engine 1 and the waste heat recovery device 2, thereby sufficiently cooling the heat generating part of the internal combustion engine 1 to dispense with a radiator while maintaining the performance of the waste heat recovery device 2. Moreover, since water fed from the low pressure pump 7 to the water jacket 105 is preheated by the heat exchanger 102 disposed in the exhaust pipe 101, the waste heat of the internal combustion engine 1 can be utilized even more effectively.

Also, as the heat exchanger 102 to which low temperature water is fed from the low pressure pump 7 is arranged downstream from the exhaust pipe 101 where the temperature of exhaust gas is lower than in the position of the evaporator 3, the surplus waste heat held by the exhaust gas can be recovered thoroughly and efficiently. Furthermore, as the water preheated by the heat exchanger 102 is fed to the water jacket 105, excessive cooling of the internal combustion engine 1 can be prevented and, at the same time, it is possible to further raise the combustion heat, namely the temperature of the exhaust gas to increase its thermal energy and to enhance the efficiency of waste heat recovery.

Although the preferred embodiment of the present invention have been described in detail so far, the invention can be modified in design in various ways without deviating from the subject matter.

For instance, although the expander 4 is described as an example of rotating fluid machines in this embodiment, the invention is also applicable to a compressor.

Although this embodiment uses steam and water as the gaseous phase working medium and the liquid phase working medium, respectively, any other appropriate working medium may be used as well.

Although the slits 76*a* of the seal ancillary members 76 open both outward in the radial direction and outward in the direction of the axis L in this embodiment, they may open only outward in the radial direction.

The invention claimed is:

1. A rotating fluid machine provided with a rotor chamber formed in a casing, a rotor accommodated rotatably in the rotor chamber, a plurality of vanes slidably supported by a plurality of vane grooves radially formed in a rotor, and a U-shaped vane seal fitted into a seal holding groove formed in the end face of each of the vanes to be in sliding contact with the inner circumferential face of the rotor chamber, the rotating fluid machine converting the pressure energy of a gaseous phase working medium fed to a vane chamber partitioned by the rotor, the casing and the vanes, into the rotational energy of the rotor and vice versa, wherein a pair of engaging holes communicating with opposite ends of the seal holding grooves are formed in the end faces of the vanes, wherein slits opening outward in the radial direction of the rotor and closing inward in the radial direction are formed in a pair of seal ancillary members fitted into the engaging holes, and wherein the opposite ends of the vane seal are fitted into the slits.

2. The rotating fluid machine according to claim 1, wherein the opposite ends of the vane seal are tightly stuck into the slits in the seal ancillary members by pressing the seal ancillary members with springy members accommodated in the bottom parts of the engaging holes in the vanes.

* * * * *